US007980390B2

(12) United States Patent
Hession et al.

(10) Patent No.: US 7,980,390 B2
(45) Date of Patent: Jul. 19, 2011

(54) CARD STRUCTURES FOR ENHANCED STACKING STRENGTH

(75) Inventors: Christopher J. Hession, Mechanicsville, VA (US); Meredith Karow, Hatboro, PA (US)

(73) Assignee: MeadWestvaco Corporation, Richmond, VA (US)

( * ) Notice: Subject to any disclaimer, the term of this patent is extended or adjusted under 35 U.S.C. 154(b) by 49 days.

(21) Appl. No.: 12/446,734

(22) PCT Filed: Nov. 5, 2007

(86) PCT No.: PCT/US2007/083571

§ 371 (c)(1),
(2), (4) Date: Apr. 22, 2009

(87) PCT Pub. No.: WO2008/058046

PCT Pub. Date: May 15, 2008

(65) Prior Publication Data

US 2010/0084300 A1 Apr. 8, 2010

Related U.S. Application Data

(60) Provisional application No. 60/864,815, filed on Nov. 8, 2006.

(51) Int. Cl.
*B65D 73/00* (2006.01)

(52) U.S. Cl. ..... 206/462; 206/764; 206/461

(58) Field of Classification Search ..... 206/461, 206/462, 463, 471, 769, 764, 759, 760, 780
See application file for complete search history.

(56) References Cited

U.S. PATENT DOCUMENTS

| | | | | |
|---|---|---|---|---|
| 3,586,163 | A * | 6/1971 | Loehrer et al. | 206/580 |
| 3,685,649 | A | 8/1972 | Diehl | |
| 3,912,079 | A | 10/1975 | Selchow | |
| 3,918,583 | A * | 11/1975 | Adams | 206/779 |
| 4,570,787 | A * | 2/1986 | Forbes, Jr. | 206/780 |
| 4,702,368 | A * | 10/1987 | Jones | 206/45.24 |
| 5,289,917 | A * | 3/1994 | Chabria | 206/232 |
| 5,392,919 | A * | 2/1995 | Passamoni | 206/576 |
| 5,782,357 | A * | 7/1998 | Johnson | 206/461 |
| 5,888,565 | A * | 3/1999 | Gics | 426/124 |

FOREIGN PATENT DOCUMENTS

| | | | |
|---|---|---|---|
| DE | 4140773 | A1 * | 6/1993 |
| EP | 1580140 | A | 9/2005 |

OTHER PUBLICATIONS

"Paperboard Packaging Ideas and Innovation, Second Edition," pp. 2.271-2.274. Paperboard Packaging Council, Oct. 23, 2004.
"International Search Report", European Patent Office, Aug. 8, 2008.

* cited by examiner

*Primary Examiner* — David T Fidei
(74) *Attorney, Agent, or Firm* — MWV Intellectual Property Group

(57) ABSTRACT

A display card (200) including a front layer (230) and a back layer (210), wherein at least a portion of the front layer (230) is connected to at least a portion of the back layer (210), a blister (220) supported by at least one of the front layer (230) and the back layer (210), and at least one support tube (240) defined by the front layer (230) and the back layer (210), wherein the support tube is formed by folding the front layer (230) relative to the back layer (210).

19 Claims, 11 Drawing Sheets

CARD STRUCTURES FOR ENHANCED STACKING STRENGTH

The present application claims priority from U.S. Ser. No. 60/864,815 filed on Nov. 8, 2006, the entire contents of which are incorporated herein by reference.

BACKGROUND

Display cards are often used to show merchandise in a store environment. Display cards are typically made from sheet material such as paperboard where the card thickness may range from about 0.012 to 0.037 inches, as compared with greater thicknesses typically characterized by corrugated packaging materials. To provide structural support or stability or stacking strength, display cards may be placed in an outer shipping case or tray. Another way to provide stacking strength is to enclose a display card, product, or carded product, within a plastic clamshell that is designed to support a load.

SUMMARY

In one aspect, the disclosed card structure may include a front layer and a back layer, wherein at least a portion of the front layer is connected to at least a portion of the back layer, a blister supported by at least one of the front layer and the back layer, and at least one support tube defined by the front layer and the back layer, wherein the support tube is formed by folding the front layer relative to the back layer.

In another aspect, the disclosed card structure may include a front panel having an inner surface and an outer surface, a back panel having an inner surface and an outer surface, wherein at least a portion of the inner surface of the front panel is connected to at least a portion of the inner surface of the back panel, a blister supported by the front panel and/or the back panel, and at least one support tube defined by folding the front panel relative to the back panel, wherein the inner surface of the front panel is spaced apart from the inner surface of the back panel at the support tube.

Other aspects of the disclosed card structures for enhanced stacking strength will become apparent from the following description, the accompanying drawings and the appended claims.

DETAILED DESCRIPTION

Display card structures are disclosed that provide stacking strength and stability. In certain embodiments, the display card structures are made using sheet materials such as paperboard, for example in thickness ranges between about 0.012 to 0.037 inches. In some embodiments, the display card structures may incorporate theft resistance, for example through use of tear-resistant paperboard such as MeadWestvaco's ENDURANCE® brand paperboard.

Figure 1:
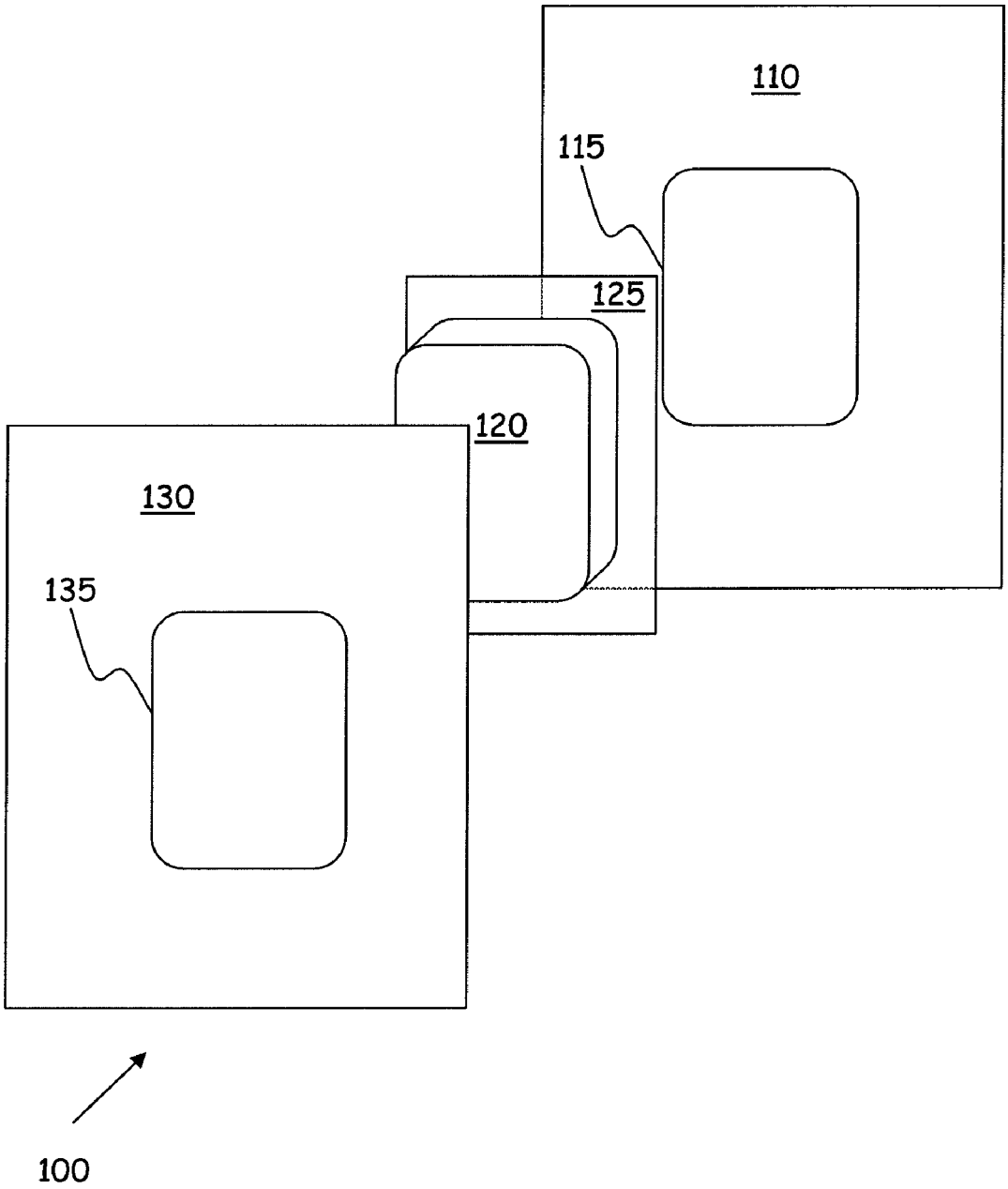
FIG. 1 shows in perspective view an unassembled display card.

FIG. 1 is a perspective view of a display card 100, shown in an unassembled state. A back panel 110 is shown, for example a rectangular piece of paperboard. A blister 120 is provided, for example a formed piece of transparent plastic, forming a cavity in which to hold an object, and also having peripheral edges 125. A front panel 130 is shown, for example a rectangular piece of paperboard, also having a cutout area 135 through which the cavity portion of blister 120 may protrude. The cavity portion of blister 120 may also protrude through an optional cutout area 115 in the back panel 110.

Figure 2:
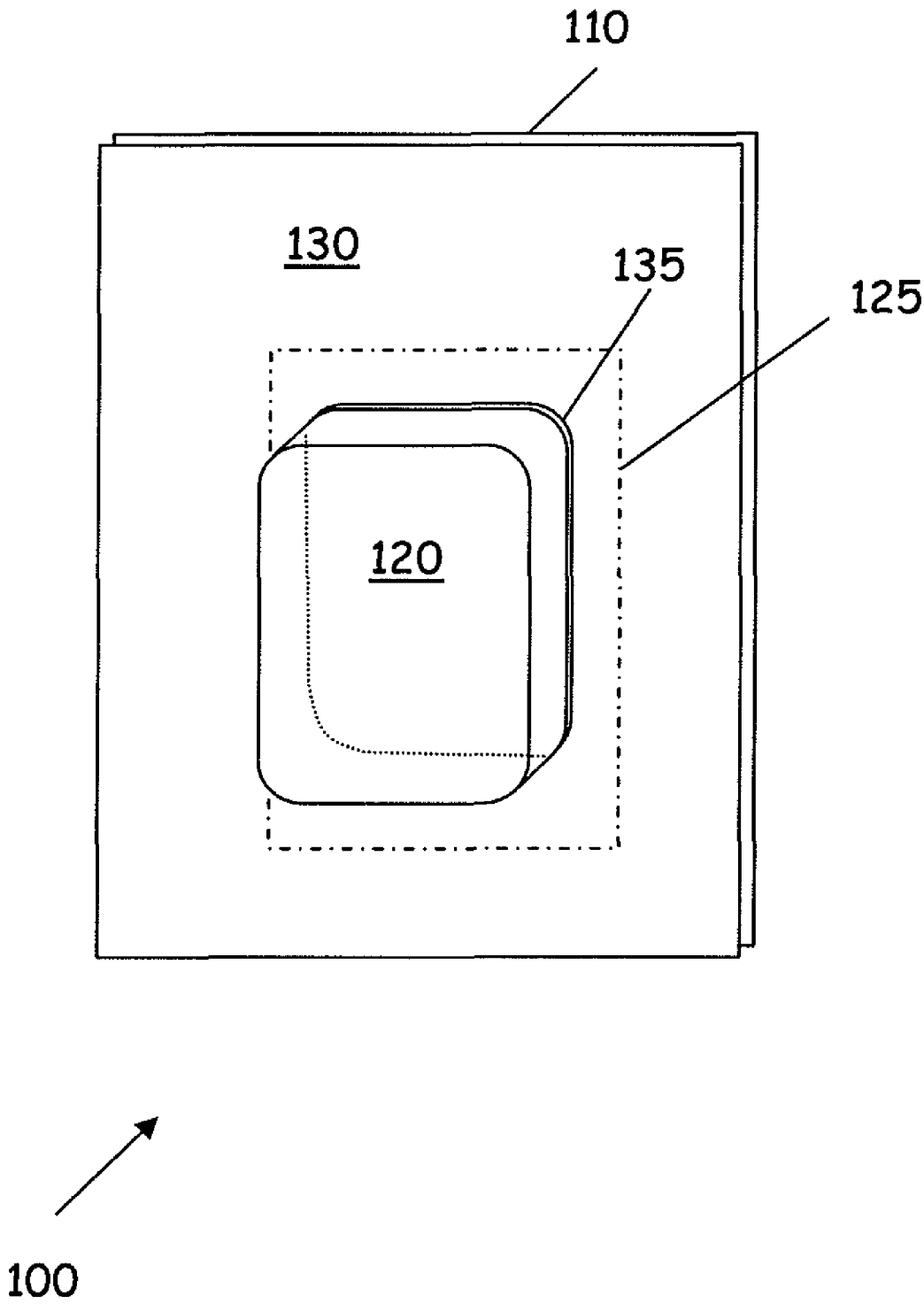
FIG. 2 shows in perspective view the assembled display card of FIG. 1.

FIG. 2 is a perspective view of the display card 100, shown in an assembled state. Typically this assembled state is achieved by placing an object in the blister 120, then sandwiching the blister 120 between the back panel 110 and front panel 130, with the periphery 125 of the blister captured between the two panels. The panels may be sealed together by any one of a variety of methods, for example by adhesive or heat sealing or by RF sealing. The back panel 110 and front panel 130 may be separate pieces, or they may be formed from one piece, joined at an edge.

Display card 100 as shown in FIG. 2 will not easily stand upright on a display shelf. Instead, several of the display cards may typically be placed in an outer package such as a corrugated carton, with at least one of its sides or top open for access to the display cards. If the outer package is to be stacked, then the front of the outer package may have an opening from which to remove the display cards.

Even when held in an outer carton, display card 100 may fall from an upright orientation as the outer carton becomes empty. This may be undesirable as the product becomes harder to see. Further, display card 100 does not provide much vertical strength for support when several outer cartons are stacked on top of one another.

Display cards are disclosed here with additional features added to improve the stacking strength of the card. The stacking features can be made using variety of methods that ultimately result in the creation of a tube or hollow beam, which is capable of supporting a load that is greater than what the card could support on its own. In one embodiment, where a substrate such as MeadWestvaco ENDURANCE® brand paperboard is used, these structural tubes may be created during the heat sealing process at same time that the product is being sealed into the card. In cases where the card does not include a heat sealable coating, like standard solid bleached sulfate (SBS), coated natural kraft (CNK), and laminates including VALERON® brand laminate (Illinois Tool Works, Inc.), the cards can be glued using a variety of hot and cold adhesives, epoxies, tapes, etc.

In its basic form, the card may be constructed using two panels, either connected at any one edge or detached. The front panel and/or back panel may be made to hold a blister, typically by means of an aperture. The front card and back card may be scored such that when sealed together, a tube or beam may be erected on or near one or both vertical edges of the card.

Figure 3:
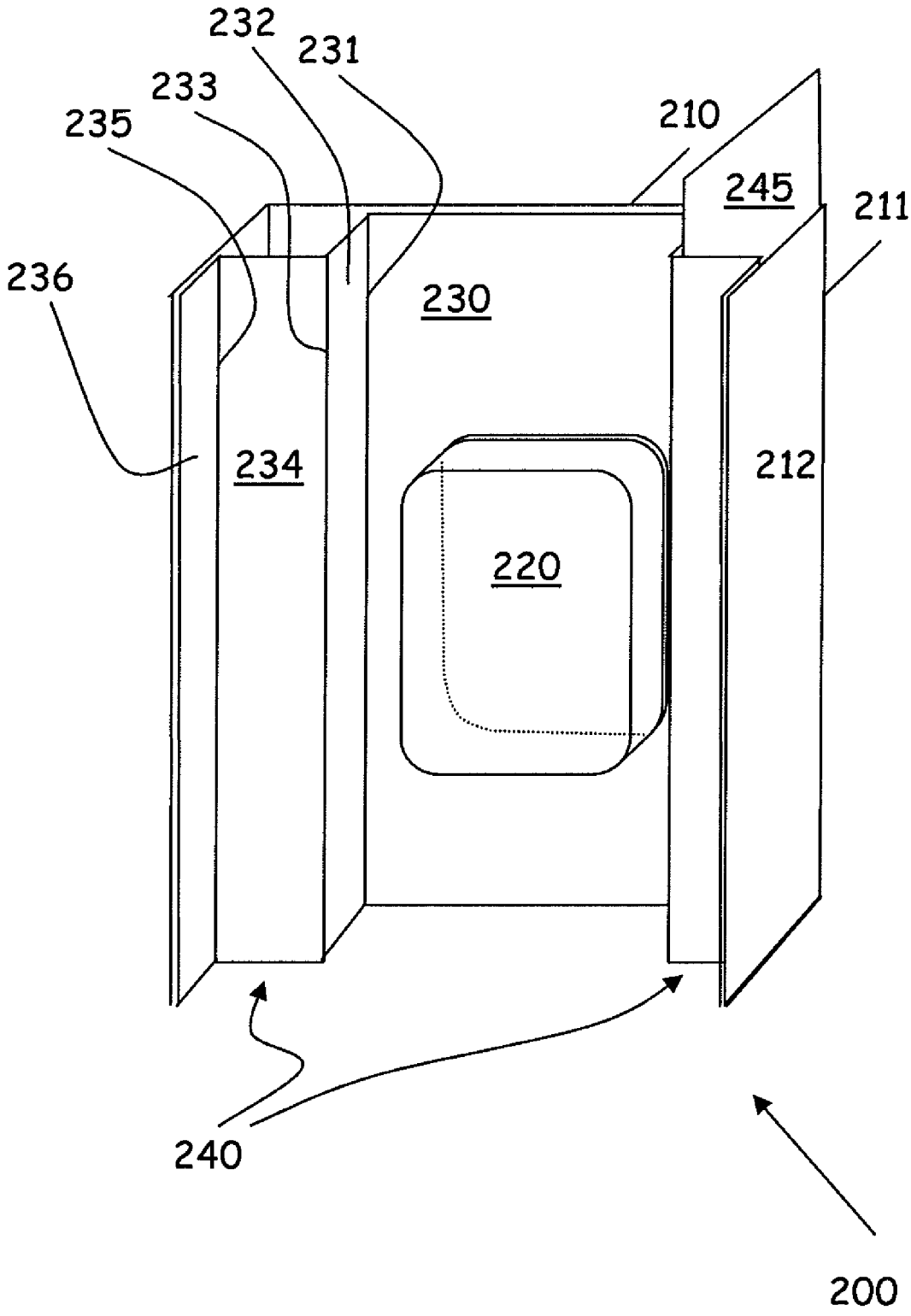
FIG. 3 shows in perspective view a display card having support tubes.

FIG. 3 shows a display card 200 in an embodiment according to the present disclosure. Support tubes 240 are provided by the design of display card 200, for example, by folding back panel 210 and front panel 230. In the embodiment shown in FIG. 3, side portions 212 of the back panel may be folded forward along score or fold line 211. The front panel 230 may have several folds, creating subpanels 232, 234, and 236 by means of score or fold lines 231, 233, and 235. At least some areas of the central portions of back panel 210 and front panel 230 may be attached to one another by, for example, adhesive or heat sealing. This helps to give some strength to the display card, and serves to contain the blister 220. Also, the subpanels 236 of the front panel may be attached to the side portions 212 of the back panel, thus forming the support tubes 240. However, subpanels 232 and 234 need not be provided with any adhesive or heat seal material, since they do not attach to the back panel.

In another embodiment, a blister may be attached to the front or back panel without the use of an aperture in the panel.

A reinforcement brace 245, such as a strip of paperboard, is shown partly inserted into support tube 240, to help retain the channel in an optional configuration. The reinforcement brace may be retained by adhesive or other suitable means. Typically. the support tubes may exhibit a certain amount of spring back to their starting positions—this spring back will create a force that will hold the reinforcement brace in place; however, tabs, slots, and other devices may be added to the reinforcement brace with corresponding features added to the cards, to help keep the reinforcement brace more permanently in place. For example, one or more tabs in the reinforcement brace may fit into one or more slots in the card or panels proximate to the support tube.

Figure 4:
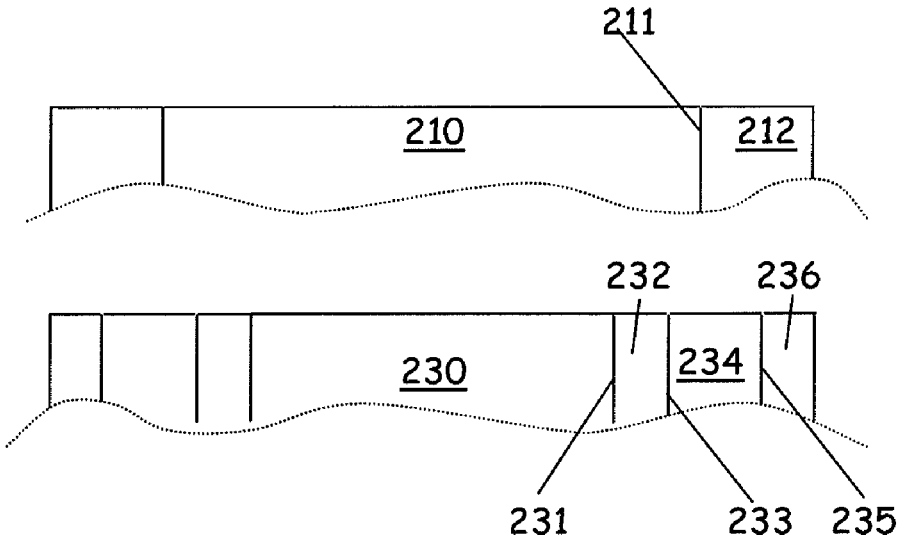
FIG. 4 shows a partial front view of unassembled panels of another display card.
Figure 5:
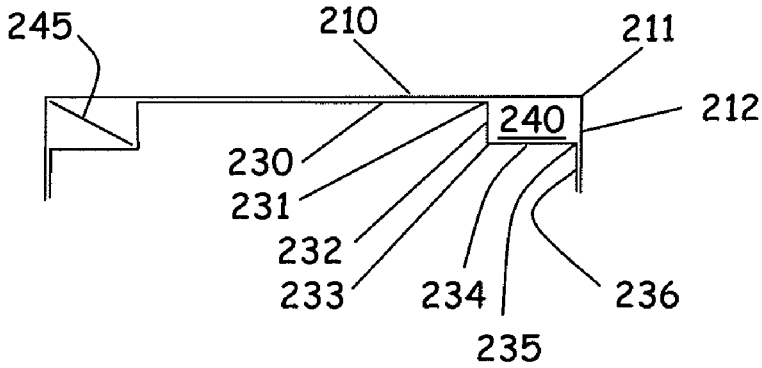
FIG. 5 shows a top view of the assembled display card of FIG. 4.

Display card 200 may be formed from a separate back panel 210 and front panel 230, or these panels may be formed from one piece, joined at an edge. FIGS. 4 and 5 further illustrate the construction of display card 200, in an embodiment where back panel 210 and front panel 230 start as separate pieces. FIG. 4 is a frontal, partial view of each panel as flat blanks while separated, and FIG. 5 is a top view of the two panels joined together in a folded configuration. The blister 220 is not shown in these FIGS. but is understood that the finished display card may comprise a blister.

At least a portion of the central part of front panel 230 is attached to the central part of back panel 210. Also front subpanels 236 are attached to the outer parts of side portions 212. Attachment may be for example by an adhesive or melt seal. It will be noted that some areas of the center of back panel 210, and some areas of side portions 212, need not have any adhesive or melt seal material. Also front subpanels 232 and 234 need not have any adhesive or melt seal material. By appropriately folding along lines 211, 231, 233, and 235, the completed display card 200 may be formed, as earlier shown in FIG. 3. Support tubes 240 are incorporated into the display card, and the support tubes may contain reinforcement braces 245.

It can thus be seen that the embodiment in FIGS. 3 to 5 represents an example of a display card that easily converts from a generally flat assembly into a standing structure with additional stacking strength. The flat assembly may be converted to the standing structure by bending the vertical edges forward.

Figure 6:
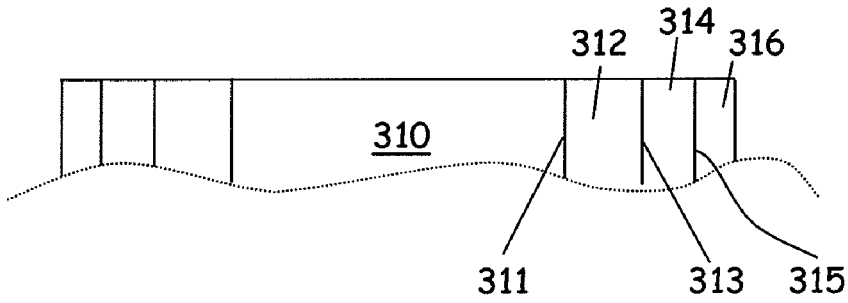
FIG. 6 shows a partial front view of unassembled panels of another display card.
Figure 7:
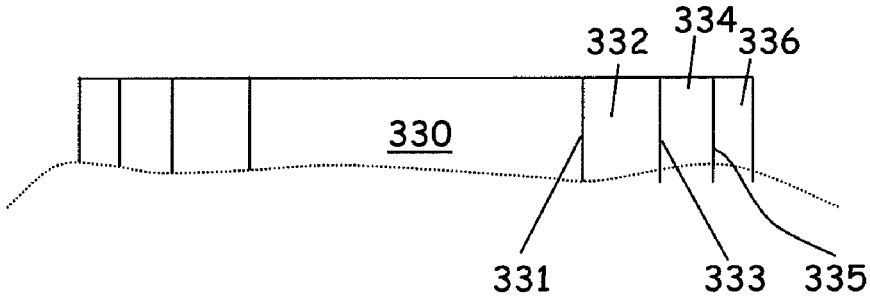
FIG. 7 shows a perspective view from the upper left of the assembled display card of FIG. 6.
Figure 7:
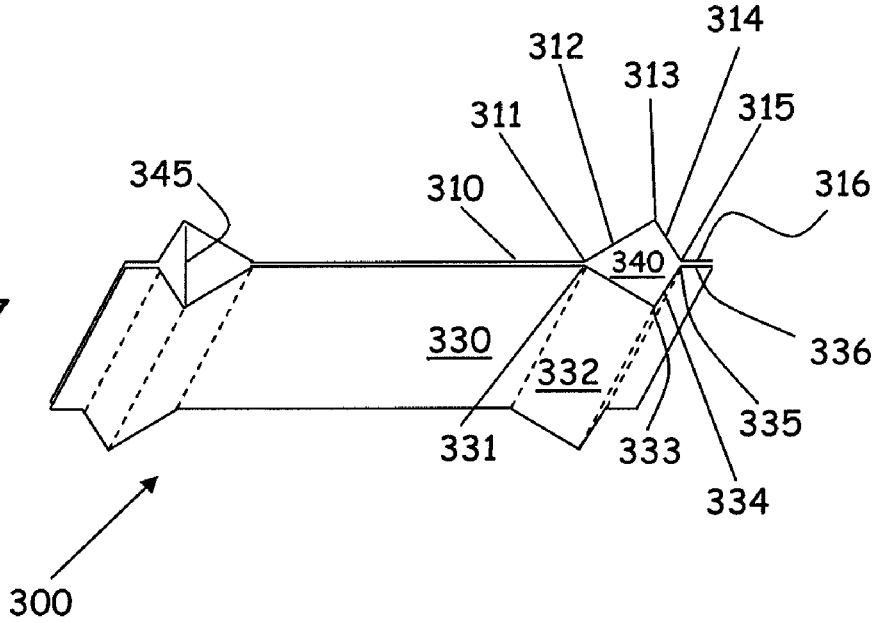

FIGS. 6 and 7 show another embodiment as display card 300, formed in this example from a separate back panel 310 and front panel 330, although these panels may be formed from one piece, joined at an edge. FIG. 6 is a frontal, partial view of each panel as flat blanks while separated, and FIG. 7 is a high-angle top view perspective view of the two panels joined together in a folded configuration. A blister is not shown in these FIGS. but is understood that at least one of the front panel 330 and back panel 310 may be formed with an aperture and the finished display card may comprise a blister. In another embodiment, a blister may be attached to the front or back panel without use of an aperture.

At least a portion of the central part of front panel 330 is attached to the central part of back panel 310. Also front subpanels 336 are attached to rear subpanels 316. Attachment may be for example by an adhesive or melt seal. It will be noted that center of back panel 310, and center of front panel 330, need not be sealed together over their entire area, although they may be sealed together over at least a portion of their area. Front subpanels 332, 334 and rear subpanels 312, 314 need not have any adhesive or melt seal material. By appropriately folding along lines 311, 313, 315, 331, 333, and 335, the completed display card 300 may be formed, as shown in FIG. 7. For example, the flat assembly may be converted into a standing assembly by pressing inward on the vertical edges of the card. Support tubes 340 are incorporated into the display card, and the support tubes may contain reinforcement braces 345.

Figure 8:
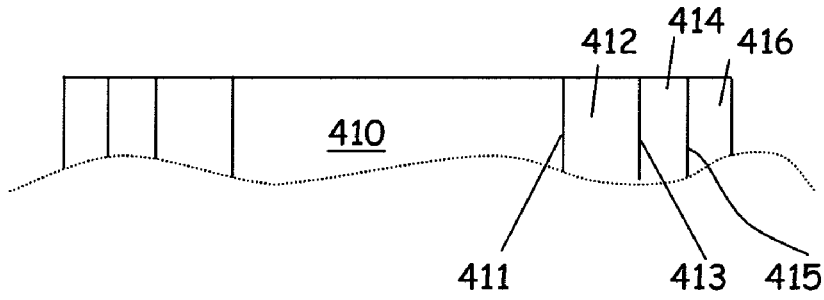
FIG. 8 shows a partial front view of unassembled panels of another display card.
Figure 9:
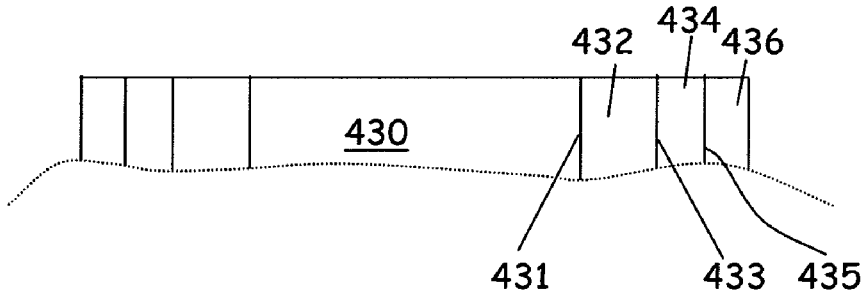
FIG. 9 shows a perspective view from the upper left of the assembled display card of FIG. 8.
Figure 9:
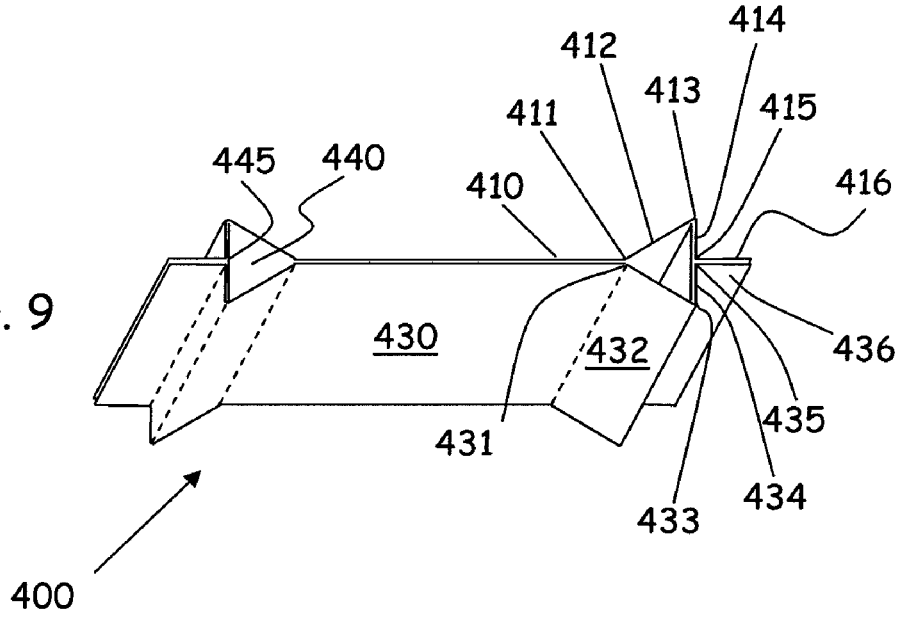

FIGS. 8 and 9 show yet another embodiment as display card 400, formed in this example from a separate back panel 410 and front panel 430, although these panels may be formed from one piece, joined at an edge. FIG. 8 is a frontal, partial view of each panel as flat blanks while separated, and FIG. 9 is a high-angle top view perspective view of the two panels joined together in a folded configuration. A blister is not shown in these FIGS. but is understood that at least one of the front panel 430 and back panel 410 may be formed with an aperture and the finished display card may comprise a blister. In another embodiment, a blister may be attached to the front or back panel without use of an aperture.

At least a portion of the central part of front panel 430 is attached to the central part of back panel 410. Also front subpanels 436 are attached to rear subpanels 416. Attachment may be for example by an adhesive or melt seal. It will be noted that center of back panel 410, and center of front panel 430, need not be sealed together over their entire area, although they may be sealed together over at least a portion of their area. Front subpanels 432, 434 and rear subpanels 412, 414 need not have any adhesive or melt seal material. By appropriately folding along lines 411, 413, 415, 431, 433, and 435, the completed display card 400 may be formed, as shown in FIG. 9. For example, the flat assembly may be converted into a standing assembly by pressing inward on the vertical edges of the card. Support tubes 440 are incorporated into the display card, and the support tubes may contain reinforcement braces 445.

Figure 10:
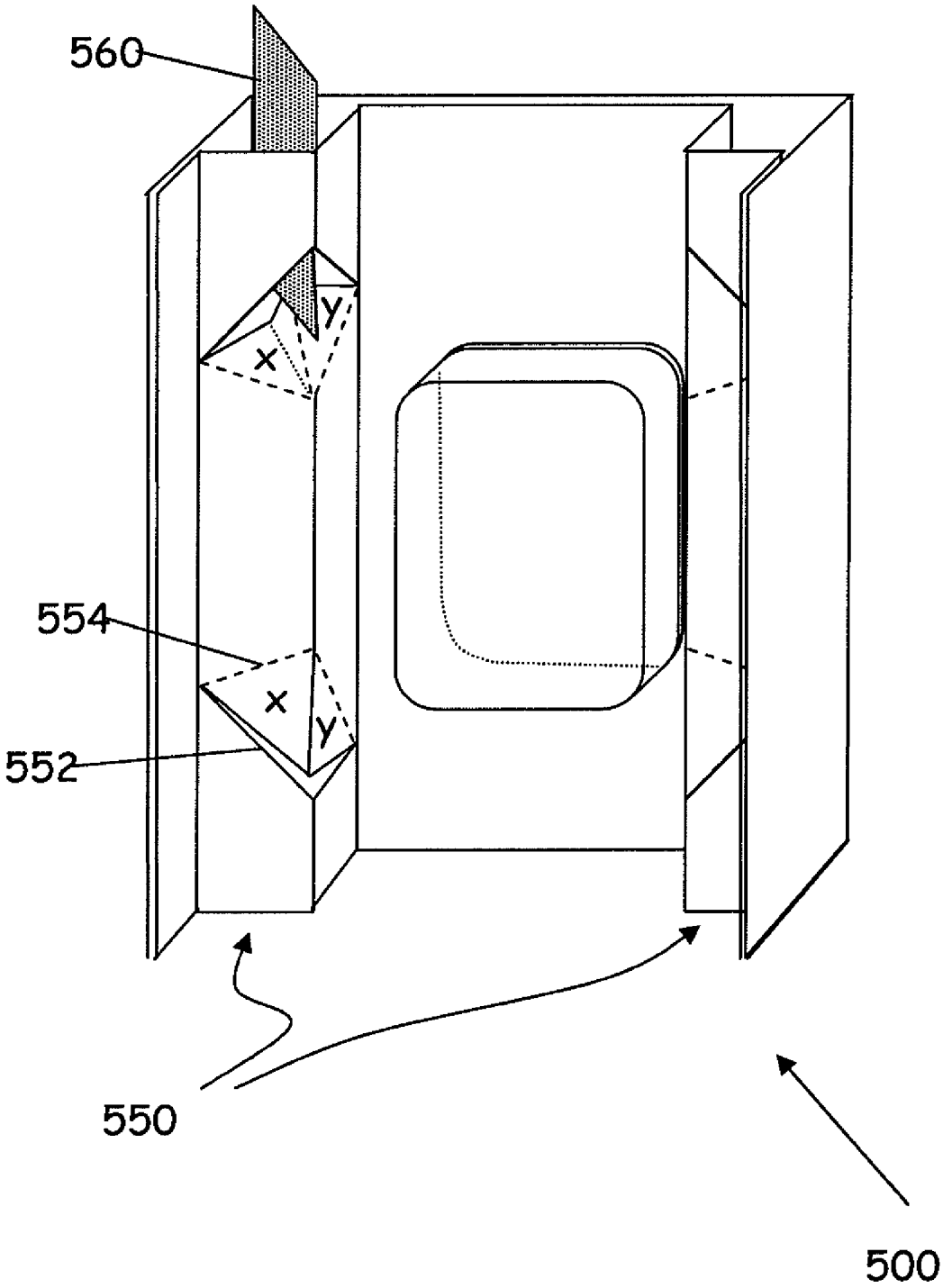
FIG. 10 shows a perspective view of an assembled display card having means for retaining support tubes in an open configuration.

FIG. 10 shows a display card 500 in an embodiment according to the present disclosure. This display card is in some respects similar to display card 200 of FIG. 3, and therefore not all details will be described. Support tubes 550 are provided by the design of display card 500. Portions of support tubes 550 may be provided with cut lines and fold lines, for example cut line 552 and fold line 554, which in this example define areas x and y in the support tube. Here, in the lower part of the support tube, cut line 552 is shown separated slightly as would occur when an inward force is directed against areas x and y. In the upper part of the support tube, the areas x and y are shown having been pushed into the support tube, to act as braces to prevent the support tube from flattening. A reinforcement 560 such as a piece of paperboard may also be used to help keep areas x and y in a bracing position.

Figure 11:
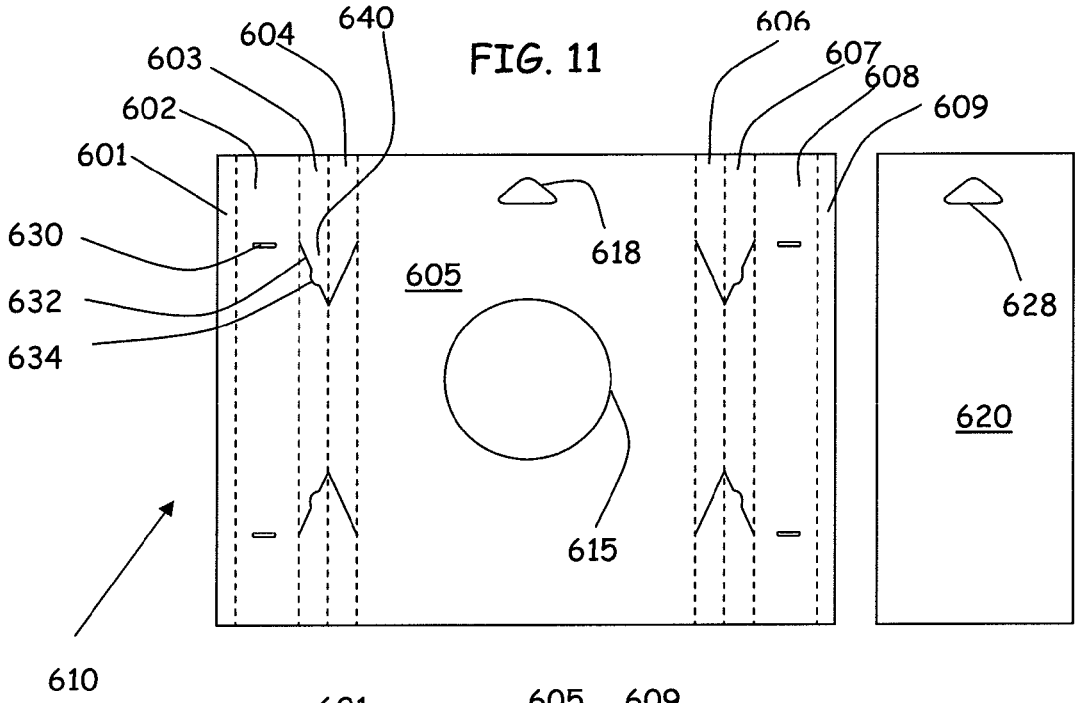
FIG. 11 shows a plan view of a blank from which another display card may be formed.
Figure 12:
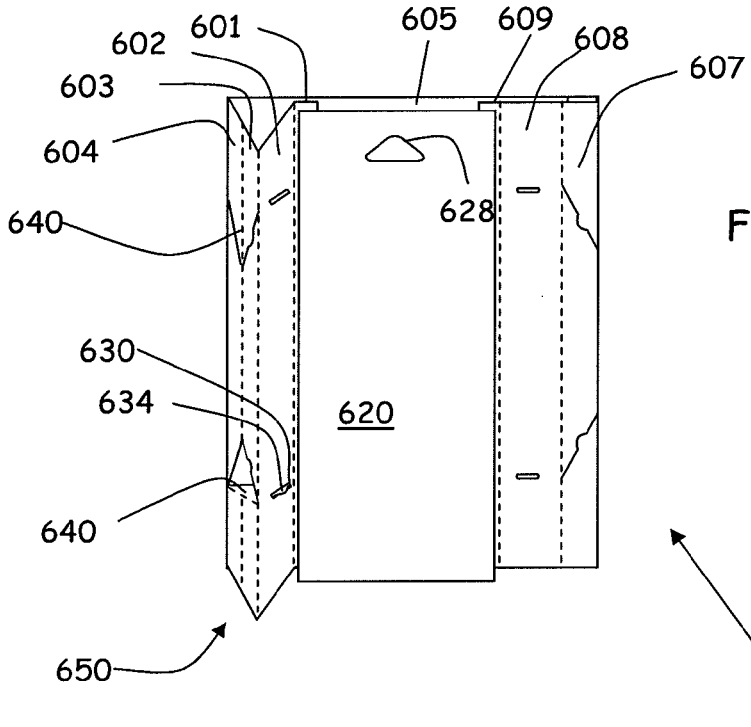
FIG. 12 shows a perspective view of the partially assembled display card formed from the blank of FIG. 11, having means for retaining support tubes in an open configuration.

FIG. 11 shows a plan view of front blank 610 and back blank 620 suitable for making a display card 600 shown in FIG. 12. Front blank 610 comprises a center panel 605, with side panels 601, 602, 603, and 604 to one side, and corresponding side panels 606, 607, 608, and 609 to the other side. The center panel 605 may have an aperture 615 to receive a blister. Hanging apertures 618, 628 may likewise be provided.

Within certain of the side panels, cut lines 632 may be provided to form a vee-shaped cut defining one or more triangular shaped flaps 640. A catch tab 634 may be provided in the cut line 632. A slot 630 may also be provided as shown.

FIG. 12 shows a back view of a display card 600 partially constructed from the front blank 610 and back blank 620. As a step in this process, the side panels 607, 608, 609 may be folded over upon side panel 606 and center panel 605, with side panel 609 being attached to center panel 605, for example by adhesive. Side panels 601, 602, 603 may likewise be folded over upon side panel 604 and center panel 605, with side panel 601 attached to center panel 605. The partly assembled structure at this stage (not shown) may be a flat structure. At this point a blister may be placed in aperture 615, and back blank 620 then attached to center panel 605.

By exerting an inward-directed force on side panels 603, 604, the structure shown in FIG. 12 may be obtained, with a support tube 650 formed in a triangular shape. Triangular shaped flap 640 may then be pushed into support tube 650, and the catch tab 634 may engage slot 630. The triangular shaped flap 640 may thus hold support tube 650 in an open configuration.

In the example display card 600, the blister (not shown) faces to the front and the support tubes face to the back of the structure. However, several different arrangements may be designed, with the blister facing either forward or backward, and the support tubes facing either forward or backward. The use of an aperture may be advantageous to capture the blister within the display structure. However, the display card may also be made without an aperture.

Figure 13:
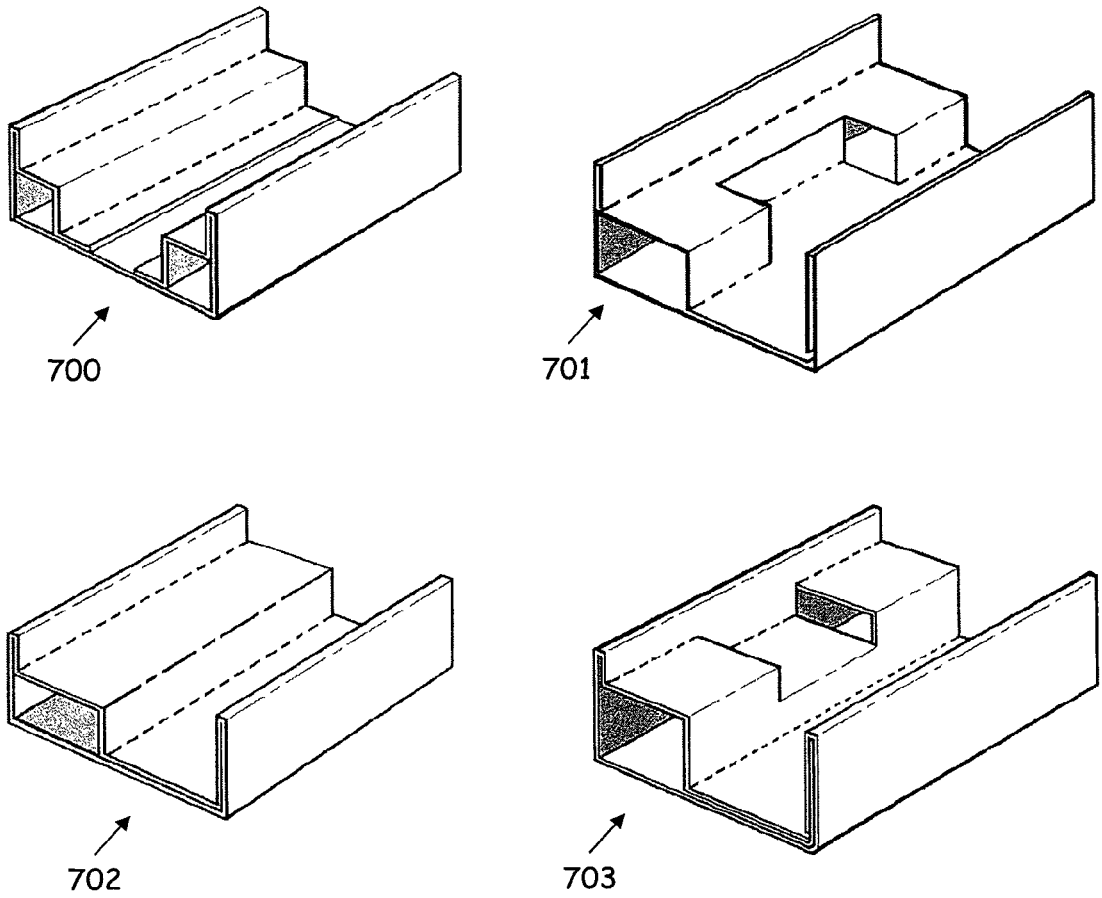
FIGS. 13 to 15 show perspective views of additional structure shapes that may be incorporated.
Figure 14:
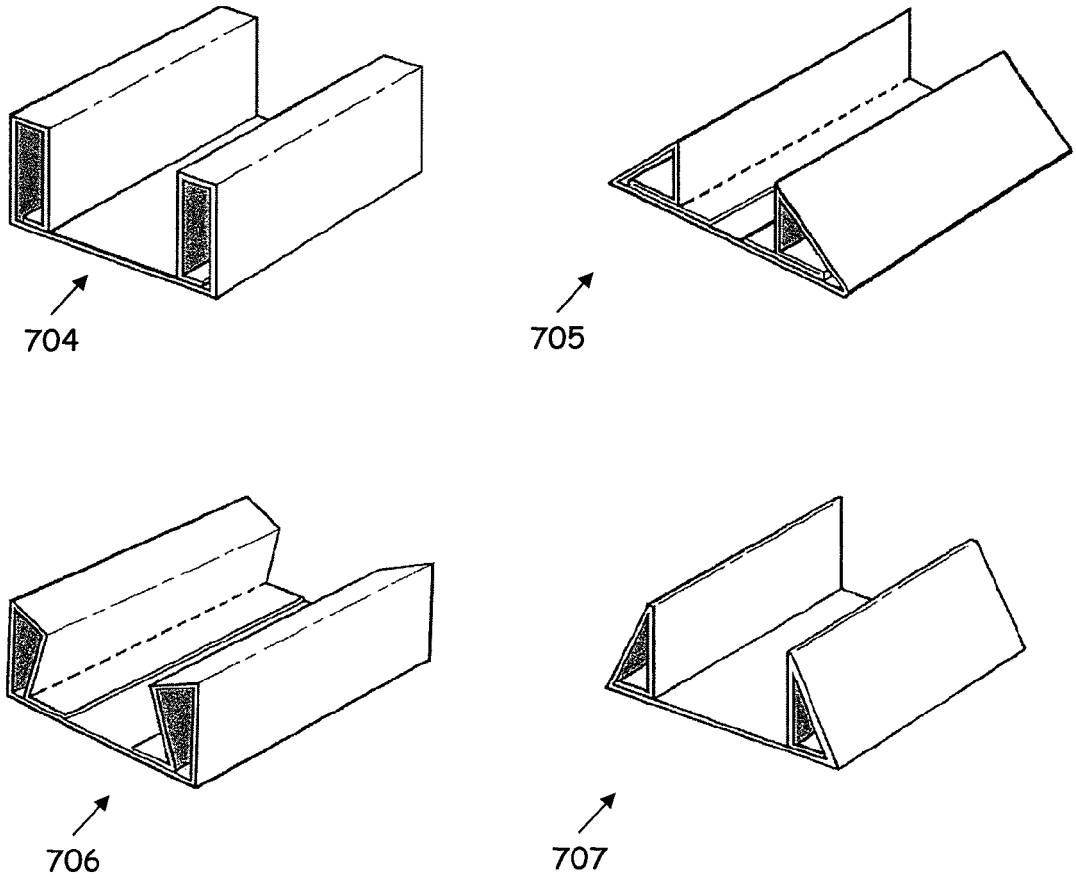
Figure 15:
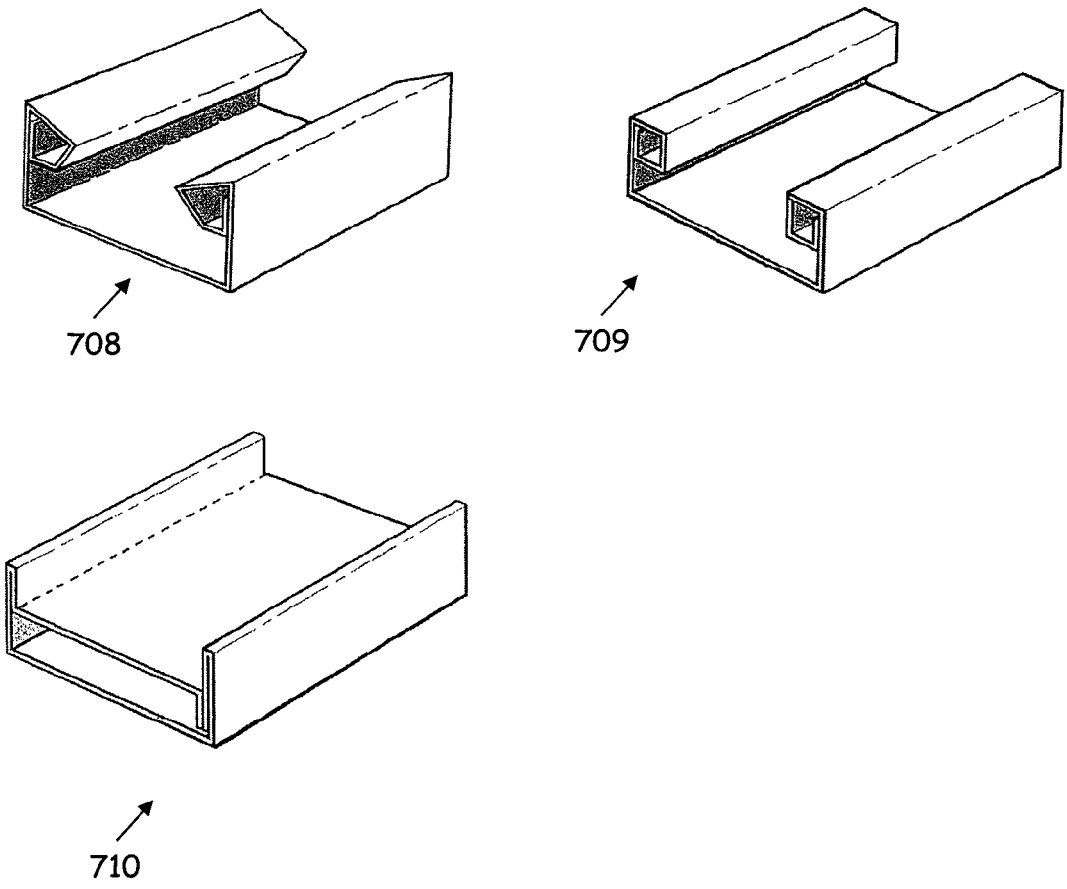

Display cards 200, 300, 400, 500 and 600 are only examples of some possible embodiments. The display card may have other shapes or structures, such as are shown in FIGS. 13, 14, and 15, with sketches of trays 700, 701, 702, 703, 704, 705, 706, 707, 708, 709, 710 as taken from "Paperboard Packaging: Ideas and Innovation, 2$^{nd}$ Edition", by the Paperboard Packaging Council. It can be easily seen that the embodiments already described may also be realized in the shapes shown in FIGS. 13 to 15, which, whether glued, heat sealed, or otherwise assembled, ultimately create a support tube structure as described above.

The card structures disclosed herein are able to stand, and to provide additional stacking strength above that of a standard flat card. In many distribution and sales environments, such as club stores, the ability to stack and display products without additional support structures, such as shelves, is highly desirable and in some cases mandated. A number of these structures also work well with existing fulfillment operations, allowing the additional support features to be incorporated at the time the product is packaged and adhered to the card.

The shape, size, number, orientation, and location of the support tubes may be chosen to provide the desired amount of strength and stability. For example, the number and cross sectional area of a support tube or tube may be made large enough, and distributed appropriately, to support any expected stacking forces. The orientation, location, and size of support tubes may be chosen to enhance the standing stability of a display card; for example, if a blister of a certain size protrudes through the front of a display card, then it may be desired to have support tubes located to the left and right sides of the card, oriented generally on the front side of the card, and with a size and shape of sufficient cross sectional area to cause the display card containing the blister to be free-standing. For example, these characteristics may be met by the design of the display card 200 of FIG. 3.

Methods of making and using the display card structures in accordance with the present disclosure should be readily apparent from the mere description as provided herein. No further discussion or illustration of such products or methods, therefore, is deemed necessary.

While certain embodiments of the present disclosure have been described and illustrated, it should be apparent that many modifications to the disclosed embodiments and implementations may be made. The present application includes such modifications and is limited only by the scope of the claims.

Although the disclosed embodiments illustrated herein have been described with reference to MeadWestvaco ENDURANCE® brand paperboard as a component of a theft resistant package, such as a MeadWestvaco NATRALOCK™ brand package, these embodiments may easily be implemented with the use of other materials, and are contemplated for use in packaging a wide variety of products including, but not limited to, pharmaceuticals, electronics, software, and other high value products for which theft resistance is required and product visibility is preferred.

What is claimed is:

1. A display card comprising:

a front layer and a back layer, the layers having a height, wherein at least a portion of said front layer is connected to at least a portion of said back layer;

a blister supported by at least one of said front layer and said back layer; and at least one support tube defined by said front layer and said back layer, extending in a longitudinal direction the entire said height of said layers and having a plurality of walls, and a reinforcement brace inside said at least one support tube extending in said longitudinal direction and not parallel to any of said walls, wherein said support tube is formed by folding said front layer relative to said back layer.

2. The display card of claim 1, wherein said blister is retained between said front layer and said back layer.

3. The display card of claim 1, wherein said blister is retained upon the surface of one of said front layer and said back layer.

4. The display card of claim 1, wherein at least one of said front layer and said back layer includes an aperture for received at least a portion of said blister therethrough.

5. The display card of claim 1, wherein said support tube is further formed by folding said back layer relative to said front layer.

6. The display card of claim 1, wherein said support tube is formed such that said front and back layers after folding are symmetric about a contact plane between said front and said back layers.

7. The display card of claim 1, wherein said support tube is formed such that after folding said display card has a generally flat back or front surface.

8. The display card of claim 1 wherein said display card defines a vertical axis and said support tube is generally aligned with said vertical axis.

9. The display card of claim 1, wherein said support tube is located and sized to support said display card in an upright stance.

10. The display card of claim 1, wherein at least one of said front and said back layers includes a tear resistant material.

11. The display card of claim 1, wherein at least portions of said front and said back layers are adhered together by an adhesive.

12. The display card of claim 1, wherein at least portions of said front and said back layers are adhered together by a heat seal material.

13. The display card of claim 12, wherein said heat seal material is coated onto at least one of said front and said back layers.

14. The display card of claim 1, wherein said front and said back layers are formed from a paperboard material.

15. The display card of claim 1, wherein said reinforcement brace extends in the direction of said support tube along at least one plane.

16. The display card of claim 1, wherein said reinforcement brace is formed from a paperboard material.

17. The display card of claim 1, wherein said reinforcement brace is defined by a portion of at least one of said front and said back layers.

18. A display card comprising:

a front panel having an inner surface and an outer surface;

a back panel having an inner surface and an outer surface, wherein at least a portion of said inner surface of said front panel is connected to at least a portion of said inner surface of said back panel, the front panel having a height;

a blister supported by at least one of said front panel and said back panel;

at least one support tube defined by folding said front panel relative to said back panel, said support tube extending in a longitudinal direction the entire said height of said front panel and having a plurality of walls; and a reinforcement brace inside said at least at least one support tube, the reinforcement brace extending in said longitudinal direction and not parallel to either of said front panel and back panel, wherein said inner surface of said front panel is generally spaced apart from said inner surface of said back panel at said support tube.

19. The display card of claim 18 wherein a portion of one of said plurality of walls is folded inward into said support tube.

* * * * *